US008844116B2

(12) United States Patent
Couzyn

(10) Patent No.: US 8,844,116 B2
(45) Date of Patent: Sep. 30, 2014

(54) METHOD OF MANUFACTURING A BUOYANCY CONTROL DEVICE

(76) Inventor: Rhys James Couzyn, Johannesburg (ZA)

( * ) Notice: Subject to any disclaimer, the term of this patent is extended or adjusted under 35 U.S.C. 154(b) by 560 days.

(21) Appl. No.: 12/673,195

(22) PCT Filed: Aug. 4, 2008

(86) PCT No.: PCT/IB2008/053110

§ 371 (c)(1),
(2), (4) Date: Apr. 13, 2010

(87) PCT Pub. No.: WO2009/022258

PCT Pub. Date: Feb. 19, 2009

(65) Prior Publication Data

US 2011/0200395 A1 Aug. 18, 2011

(30) Foreign Application Priority Data

Aug. 10, 2007 (ZA) ..... 2007/06650

(51) Int. Cl.
*B63C 11/02* (2006.01)
*B63C 11/08* (2006.01)

(52) U.S. Cl.
CPC ..... *B63C 11/02* (2013.01); *B63C 2011/085* (2013.01)
USPC ..... 29/527.1; 405/185; 405/186; 405/187; 156/91; 441/88; 441/106; 441/108; 264/250; 264/310; 29/428; 29/525.01; 29/527.2

(58) Field of Classification Search
USPC ..... 405/185, 186, 187; 2/2.15; 128/201.27; 441/56, 102, 88, 106, 108; 264/250, 264/310; 156/91; 29/428, 525.01, 527.1, 29/527.2
See application file for complete search history.

(56) References Cited

U.S. PATENT DOCUMENTS

| | | | | |
|---|---|---|---|---|
| 3,090,205 | A * | 5/1963 | Hurwitz et al. | 405/186 |
| 4,137,585 | A * | 2/1979 | Wright, III | 405/193 |
| 5,954,250 | A * | 9/1999 | Hall et al. | 224/262 |
| 6,021,528 | A * | 2/2000 | Jurga et al. | 2/326 |
| 6,120,213 | A * | 9/2000 | Stinton | 405/186 |
| 2005/0098597 | A1 | 5/2005 | Cottrell et al. | |
| 2006/0144885 | A1 * | 7/2006 | Smeuninx | 224/629 |

FOREIGN PATENT DOCUMENTS

| | | |
|---|---|---|
| FR | 1 235 501 A | 7/1960 |
| GB | 1 546 755 A | 5/1979 |

OTHER PUBLICATIONS

International Search Report, dated Jan. 28, 2009, from corresponding PCT application.

* cited by examiner

*Primary Examiner* — Sunil Singh
*Assistant Examiner* — Carib Oquendo
(74) *Attorney, Agent, or Firm* — Young & Thompson

(57) ABSTRACT

A method of manufacturing a harness for a buoyancy control device, and a harness manufactured by such method. There is provided a method of manufacturing a harness for a buoyancy control device for use in a diving application, the method including the steps of: providing polymeric material; molding the polymeric material into separate components of the harness; and connecting the components to one another so as to form the harness. A harness including a plurality of molded polymeric components interconnected is also described.

13 Claims, 3 Drawing Sheets

METHOD OF MANUFACTURING A BUOYANCY CONTROL DEVICE

FIELD OF THE INVENTION

This invention relates to a method of manufacturing a harness for a buoyancy control device, and to a harness device manufactured by such method. More particularly, but not exclusively, the invention relates to a method of manufacturing a harness for a buoyancy control device utilising a moulding process, and to a harness for a buoyancy control device comprising a plurality of interconnected moulded components.

BACKGROUND TO THE INVENTION

A buoyancy control device (BCD), also known as a buoyancy compensator (BC), is a piece of diving equipment worn by a diver, that assists the diver to regulate and control his or her overall buoyancy relative to the water. The purpose of the buoyancy control device is to assist the diver in obtaining neutral buoyancy wherein the weight of the diving equipment is cancelled out, thus allowing the diver to ascend and descend in a controlled manner. The buoyancy control device also provides positive buoyancy when a diver is at the water surface, thus allowing the diver to float irrespective of the heavy equipment and diving suit being carried.

A buoyancy control device typically includes a harness component that is worn by the diver, and to which diving cylinder(s) are also secured. The buoyancy control device also includes an air cell or bladder, which is attached to the harness and is selectively inflatable and deflatable to provide positive buoyancy at the surface, or neutral buoyancy underwater.

Buoyancy control device designs known in the art typically utilise a harness constructed of various layers of fabric, foam and/or plastic backing stitched together so as to form composite shoulder straps, waist closures and a back section. The back section often also includes a rigid plastic or metal back plate for additional structural support of the cylinder.

The above design essentially comprises a plurality of fabric layers being stitched or otherwise joined together so as to form a composite buoyancy control device. By the very nature thereof, this process is time-consuming, laborious and thus costly. Further, as most fabrics used are water absorbent, the buoyancy control device remains wet long after having been used in a dive. Also, fabrics are prone to degradation due to continued exposure to chemicals and sunlight.

The air cells or bladders are usually manufactured from sheets of polyurethane, or nylon with a polyurethane backing. Sheets are located adjacent one another so that the sheets substantially overlie one another, and a seam is subsequently formed by gluing or welding the edges of the sheets together. Thereafter a bead is usually stitched around the border of the air cell. However, most failures of buoyancy control devices are related to stitching coming loose or failure of an air cell or bladder seam.

Prior art harness for buoyancy control devices known to the Applicant includes FR 1235501 which describes a dorsal plate which serves as a carrier for a compressed air cylinder for underwater diving. It has a loop at the top to engage the collar of the cylinder and two attachment points for attaching straps for carrying on the back of a diver. This is an early arrangement for diving which was in existence prior to the arrival of buoyancy control devices in their current form. This arrangement includes attachments for shoulder straps made of webbing but would be used without an inflatable air cell or with an inflatable collar (similar to a life jacket) to increase the buoyancy of the diver. It therefore differs from and could not be used with a buoyancy control device comprising a backpack or harness including an inflatable cell. In addition the method for holding the dorsal plate onto the diver is not described—this being fundamental to applicant's invention.

A further patent, GB 1546755 describes a detachable mounting plate for a cylinder. In this case it is clear that this is attachable to a harness or backpack for use by a diver. The patent drawings (FIG. 1) illustrate a type of rubber harness shown as a one-piece construction (similar to a bib) and secured by waist buckles. This harness is neither described nor claimed in the patent. Apart from the fact that this comprises a unitary construction as opposed to multi-component construction of the current invention, this would be an ungainly, impractical and ill-fitting harness which was possibly used for a short time if at all, until progress realised improved versions. Given that the invention of GB 1546755 was in fact a novel dorsal plate for a diving harness, FIG. 1 may have been used purely for illustrative purposes. In the event that this bib-type harness was used, it would in all likelihood have been cut from a flat sheet of rubber or other material. Any attachments would need to be glued, riveted or stitched on whereas the applicant's invention is specifically a moulded construction that allows all attachments, logos and the like to be integrated into the design. Furthermore, the design of the bib would, by nature of its unitary construction, have no shoulder-strap/torso-length adjustment, very limited waist adjustment and, very importantly, no means of removal by the diver easily in the case of an emergency. In addition, with the unitary design, different sizes would require totally different components. The benefit of the applicant's modular design is that the back plate is common but the sizing is easily changed by fitting different sized shoulder straps and/or waist straps.

OBJECT OF THE INVENTION

It is accordingly an object of the invention to provide a method of manufacturing a harness for a buoyancy control device, and a harness manufactured by such method, which will, at least partially, overcome the disadvantages as described above.

It is also an object of the invention to provide a method of manufacturing a harness for a buoyancy control device, and a harness manufactured by such method, that will be a useful alternative to existing methods and buoyancy control devices.

In particular, it is also an object of the invention to provide a method of manufacturing a harness for a buoyancy control device, and a harness manufactured by such method that involves no stitching, gluing or welding, and which does not involve the use of a material that is excessively water absorbent.

SUMMARY OF THE INVENTION

According to the invention there is provided a method of manufacturing a harness for a buoyancy control device for use in a diving application, the method including the steps of:

- providing polymeric material;
- moulding the polymeric material into separate components of the harness; and
- connecting the components to one another so as to form the harness.

The components moulded from the polymeric material may include a back plate, a shoulder strap and a waist strap. Preferably there are two shoulder straps and two waist straps.

There is also provided for webbing and/or auxiliary connecting members to be moulded into the components.

There is provided for the step of moulding the polymeric material into separate components to be an injection moulding process.

The components may be connected to one another by way of mechanical connecting means. The mechanical connecting means may be selected from the group including pins, rivets, rods and bolts.

The shoulder straps and waist straps are pivotably connected to the back plate.

The method may also include the steps of:

moulding a hollow body from polymeric material; and securing the hollow body to the harness.

The hollow body may be in the form of an inflatable bladder or air cell for use in adjusting the buoyancy of the buoyancy control device.

There is provided for the step of moulding the polymeric material into a hollow body to be a rotational moulding process.

The hollow body may be secured to the harness by way of mechanical connecting means. The mechanical connecting means may be selected from the group including pins, rivets, rods and bolts.

According to a further aspect of the invention there is provided a harness for a buoyancy control device for use in a diving application, the harness including a plurality of moulded interconnected polymeric components.

The components may include a back plate, two shoulder straps and two waist straps, the straps being pivotably connected to the back plate.

Securing means is provided for securing the shoulder straps to opposing waist straps. The securing means may be in the form of webbing strips extending from the waist straps and the shoulder straps, the webbing strips terminating in complementary snap-lock buckles. The webbing strips may be integrally moulded with the straps, or may be mechanically secured to the straps after the straps have been moulded.

A moulded hollow body connected to the harness may be provided, the hollow body being adapted to be inflatable so as to act as an air bladder or an air cell.

BRIEF DESCRIPTION OF THE DRAWINGS

A preferred embodiment of the invention is described by way of a non-limiting example, and with reference to the accompanying figures, in which.

DETAILED DESCRIPTION OF THE INVENTION

Figure 1:
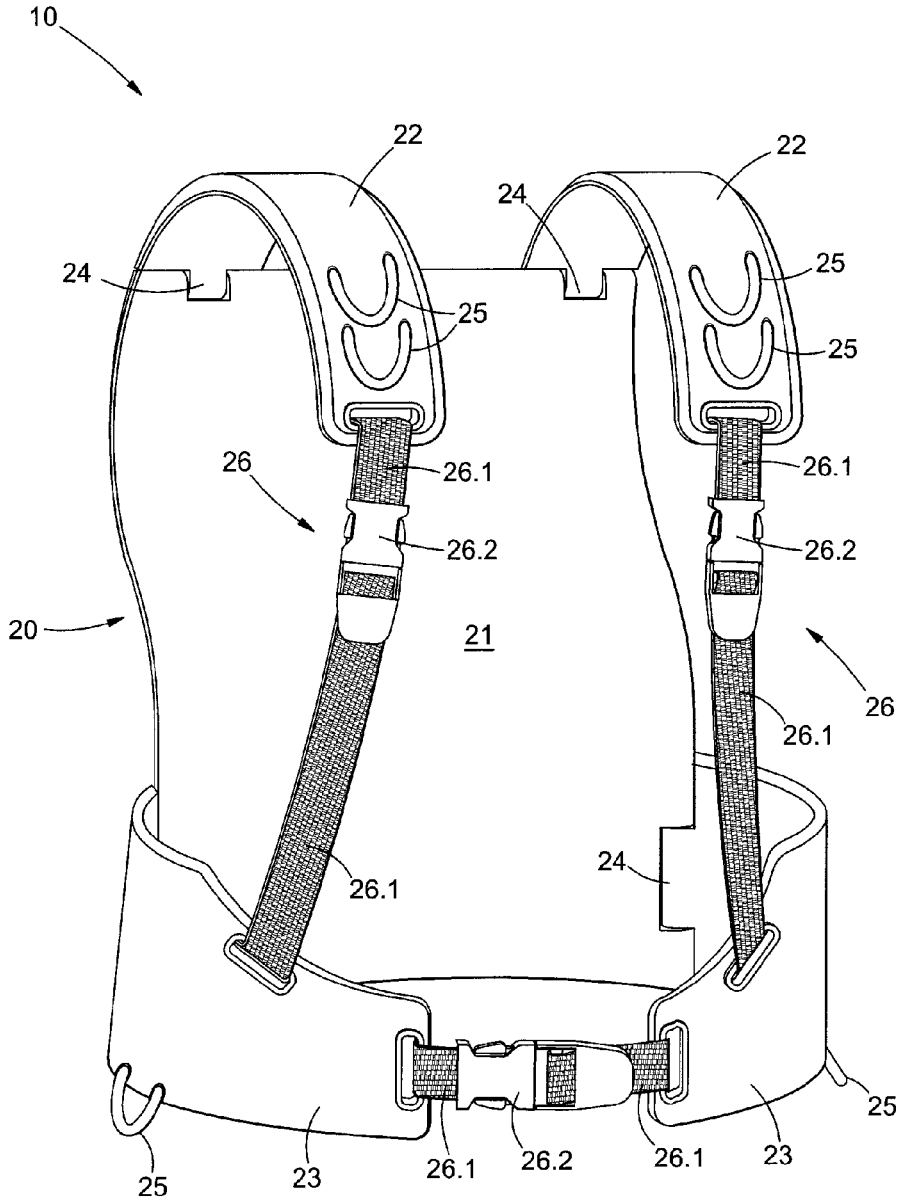
FIG. 1 is a perspective view of the harness in accordance with the invention.

Referring to the drawings, in which like numerals indicate like features, a buoyancy control device is generally indicated by reference numeral 10. In the trade, the buoyancy control device 10 is also often referred to as a buoyancy compensator (BC). The buoyancy control device 10 includes a harness 20, and at least one air cell 30 being secured to the harness 20.

Figure 2:
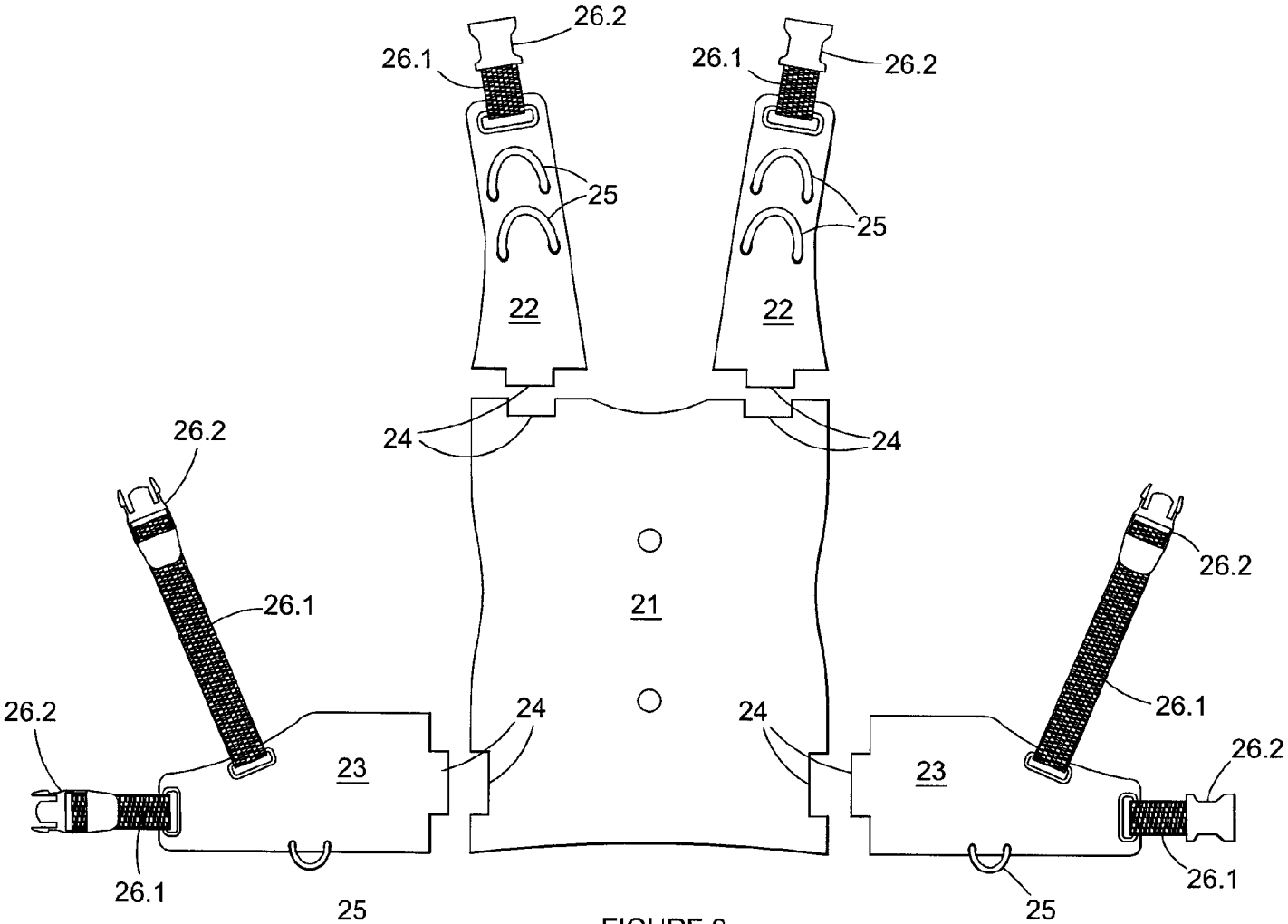
FIG. 2 is an exploded plan view of the harness FIG. 1.

FIGS. 1 and 2 show a harness 20 in accordance with the invention. The harness 20 comprises a plurality of separately moulded components that are interconnected so as to form a harness 20. The components include a back plate 21, two shoulder straps 22 and two waist straps 23. The shoulder straps 22 and the waist straps 23 are connected to the back plate 21 by way of pivotable connections 24, so as to allow the shoulder straps 22 and the waist straps 23 to be able to pivot relative to the back plate 21. The pivotable connections 24 may be of many different configurations, and may for instance be in the form of connecting pins about which the shoulder straps 22 and the waist straps 23 can pivot. The components 21, 22 and 23 are made from a rubber-like polymeric material, and are manufactured in a moulding process. Preferably an injection moulding process is utilised.

During the moulding process, attachment means 25 are co-moulded with the shoulder straps 22 and waist straps 23. These attachment means 25 may be of many different configurations and may inter alia be rigid or semi rigid fittings or supports. The attachment means 25 may also approximate the well-known D-rings as is often used in diving applications. The shoulder straps 22 are releasably secured to the waist straps 23 by way of securing means 26. The securing means 26 are in the form of webbing strips 26.1 that extend from the shoulder straps 22 as well as the waist straps 23, wherein opposing webbing strips 26.1 terminate in complementary snap-lock buckles 26.2. The webbing strips 26.1 may be moulded into the straps, and alternatively may be secured to the straps after the straps have been moulded. A similar securing configuration is provided between the two waist strips 23.

Figure 3:
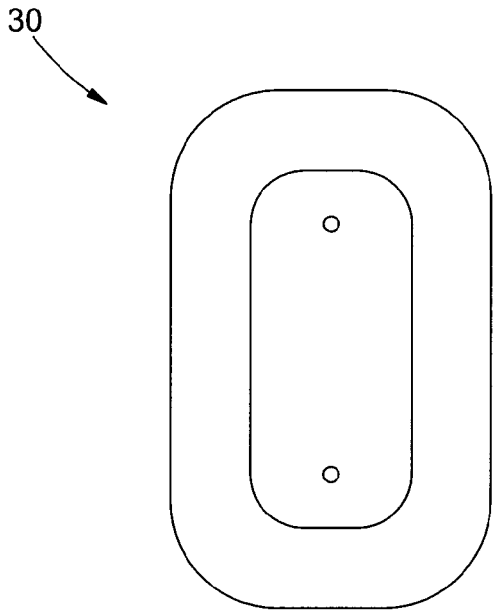
FIG. 3 shows a plan view of a first air cell forming part of a buoyancy control device.
Figure 4:
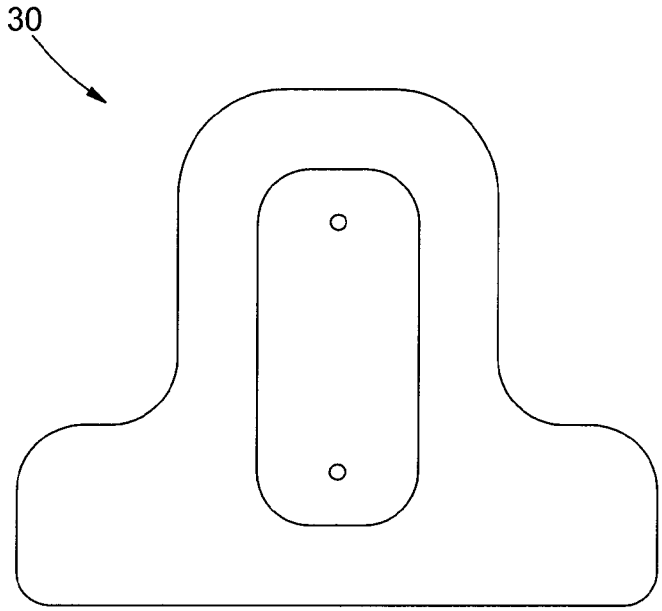
FIG. 4 is a plan view of a second embodiment of the air cell of FIG. 3.

A hollow body in the form of an inflatable air cell 30 or bladder, is also provided and is typically also manufactured in a moulding process from a suitable polymeric material. In this particular case, a rotational moulding process is utilized in order to form the hollow body. A first type of hollow body or air cell 30 is shown in FIG. 3 and comprises a back inflation air cell that is secured to a rear face of the back plate 21. A second embodiment of the air cell is shown in FIG. 4, and is in the form of a wrap-around air cell, which is also secured to a rear face of the back plate 21, but which extends at least partially around the harness and thus the diver's sides so as to provide for more efficient balancing. Irrespective of which air cell configuration is utilized, the air cell 30 will be made in a rotational moulding process, and will be secured to the harness 20 after manufacturing, so as to complete the buoyancy control device 10.

It will be appreciated that almost the entire buoyancy control device 10 will be manufactured in various moulding processes from a suitable polymeric material. No further layers of material will have to be applied to the components so manufactured, as the polymeric material, such as a rubber-like material, will provide sufficient structural rigidity, whilst still being soft enough in order for an additional foam layer to be omitted. Also, no fabric layer is required on the outside, thus negating the problems associated with the excessive drying time of existing buoyancy control devices. It is also foreseen that the polymeric material will be less prone to damage due to exposure to sunlight and chemicals.

It will be appreciated that the above is only one embodiment of the invention and that there may be many variations without departing from the spirit and/or the scope of the invention. For example, it is also foreseen that the harness may be moulded as one single component, with only the air cell being secured to the harness after fabrication. Also, the webbing strips may to a large extent be omitted, as the securing means 26 may also be integrally moulded with the shoulder straps and waist straps respectively.

The invention claimed is:

1. A method of manufacturing a harness for a buoyancy control device for use in a diving application, the method including the steps of:

providing polymeric material;

moulding the polymeric material into separate components of the harness, said moulding step comprising utilizing a rotational moulding process to form a hollow body, the hollow body being an inflatable bladder for use in adjusting the buoyancy of the buoyancy control device; and connecting the components to one another so as to form the harness.

2. The method according to claim 1, wherein, the components moulded from the polymeric material include, a shoulder strap and a waist strap, connectable to a back plate, and the connecting step includes connecting the shoulder strap, the waist strap, and the inflatable bladder to the back plate, with the inflatable bladder connected to a rear face of the back plate.

3. The method according to claim 2, wherein, the inflatable bladder is connected to a rear face of the back plate, and the inflatable bladder is formed as a wrap-around air cell which extends, when in use with a diver, at least partially around the harness to the diver's sides.

4. The method according to claim 1, wherein the components include two shoulder straps and two waist straps.

5. The method according to claim 4, wherein the shoulder straps and waist straps are pivotably connected to a back plate.

6. The method according to claim 1, wherein the components include webbing and/or auxiliary connecting members moulded into the components.

7. The method according to claim 1, wherein the step of moulding the polymeric material into separate components includes an injection moulding process.

8. The method according to claim 1, wherein the components are connected to one another by way of mechanical connecting means.

9. The method according to claim 8, wherein the mechanical connecting means is selected from the group including pins, rivets, rods and bolts.

10. The method according to claim 1, wherein the moulded inflatable bladder is secured to the harness by way of mechanical connecting means.

11. The method according to claim 1, further comprising:

providing a back plate with first parts of a pivotable connection located along an edge of the back plate, and wherein, the components moulded from the polymeric material include two shoulder straps and two waist straps connectable to the back plate, each shoulder strap with a second part of the pivotable connection, and each waist strap with a further second part of the pivotable connection, and said connecting step includes i) engaging the second part of the pivotable connection with a corresponding one of the first parts of the pivotable connection to pivotably connect the two shoulder straps to the edge of the back plate to allow the shoulder straps to each pivot relative to the back plate about the pivotable connections, and ii) engaging the further second part of the pivotable connection with another corresponding one of the first parts of the pivotable connection to pivotably connect the two waist straps to the edge of the back plate to allow the waist straps to each pivot relative to the back plate about the pivotable connections.

12. The method according to claim 11, wherein, the inflatable bladder is connected to a rear face of the back plate, and the inflatable bladder is formed as a wrap-around air cell which extends, when in use with a diver, at least partially around the harness to the diver's sides.

13. The method according to claim 11, wherein, the first and second parts of each pivotable connection include a notch and a mating protrusion inserted in the notch and connected thereto with a mechanical connecting means.

* * * * *